US005874871A

United States Patent [19]

Didriksen et al.

[11] Patent Number: 5,874,871

[45] Date of Patent: Feb. 23, 1999

[54] MOUNTING OF DIELECTRIC RESONATORS

[75] Inventors: Niels Morten Didriksen, Hörsholm; Ove Knudsen, Virum, both of Denmark

[73] Assignee: Telefonaktiebolaget LM Ericsson, Stockholm, Sweden

[21] Appl. No.: 820,088

[22] Filed: Mar. 19, 1997

[30] Foreign Application Priority Data

Mar. 27, 1996 [SE] Sweden ..... 9601166

[51] Int. Cl.[6] ..... H01P 7/10

[52] U.S. Cl. ..... 333/202; 333/219.1

[58] Field of Search ..... 333/202, 219, 333/219.1, 235

[56] References Cited

U.S. PATENT DOCUMENTS

| | | | |
|---|---|---|---|
| 3,713,051 | 1/1973 | Kell | 333/205 |
| 4,028,652 | 6/1977 | Wakino et al. | 333/209 |
| 4,560,965 | 12/1985 | Gosling et al. | 333/219 |
| 5,070,313 | 12/1991 | Gladh et al. | 333/219.1 X |
| 5,352,997 | 10/1994 | Sarkka | 333/235 X |
| 5,517,162 | 5/1996 | Ariyoshi | 333/222 |
| 5,576,674 | 11/1996 | Jachowski | 333/219.1 X |
| 5,612,655 | 3/1997 | Stronks et al. | 333/202 |

FOREIGN PATENT DOCUMENTS

| | | | |
|---|---|---|---|
| 0 438 807 | 7/1991 | European Pat. Off. . | |
| 2276039 | 9/1994 | United Kingdom | 333/202 |

OTHER PUBLICATIONS

Patent Abstracts of Japan, vol. 11, No. 108, E–495, abstract of JP, A, 61–255102 (FUJITSU LTD), Nov. 12, 1986.

*Primary Examiner*—Seungsook Ham
*Attorney, Agent, or Firm*—Burns, Doane, Swecker & Mathis, L.L.P.

[57] ABSTRACT

The present invention relates to a mounting device (31) for mounting at least one microwave resonator (20) in a dielectric resonance filter (1). The outer contours of the mounting device (31) are adapted with respect to shape and size such as to fit into a microwave filter cavity defined by a shielding device (10). The mounting device (31) is made of a foamed polymeric material. The mounting device includes at least one hollow (32) within whose defining surface there is provided at least one recess (33) for affixing the microwave resonators (20) in the mounting device (31). The invention also relates to a method of mounting the microwave resonators in the resonance filter.

5 Claims, 2 Drawing Sheets

MOUNTING OF DIELECTRIC RESONATORS

FIELD OF INVENTION

The present invention relates to a method and to a device for mounting dielectric resonators in a microwave filter.

DESCRIPTION OF THE PRIOR ART

Although different forms of dielectric microwave resonators are commercially available, the microwave resonators that are most often used have the form of short circular straight-wall cylinders which may have or may not have an axially-extending hole in the centre of the cylinder and a length-to-radius ratio which is often close to one. The resonators are often surrounded by a shielding casing to prevent radiation losses. The casing defines a microwave filter cavity.

Although not achievable in practice, the dielectric microwave resonators should ideally hang freely in space. It is therefore necessary to mount the dielectric resonators firmly within a cavity with the aid of some form of mounting device. Known devices for mounting dielectric microwave resonators in cavities impair the electric quality factor of the resonators. The resonator mounting device must be sufficiently stable and have sufficient strength to withstand the vibrations to which the resonators can be subjected. It is also suitable to adapt the coefficient of expansion of the mounting device to the resonators and to the cavity in which the resonators and the mounting device are located, in order to minimize thermally induced stresses in the resonators.

GB 2 276 039 teaches a device for mounting dielectric microwave resonators in a microwave filter cavity. A resonance filter includes the aforesaid microwave filter cavity together with at least one microwave resonator. The mounting device consists of a ceramic disc which is fastened in the filter cavity on flanges disposed on the inner cavity walls, with the aid of a screw joint. The disc includes a hole that is adapted to the resonator. The resonator is either glued in position or held with the aid of a ceramic fastener means. Adjusting the mounting device to its correct position is a relatively complicated procedure, while the task of securing the device in the cavity and mounting the resonators therein are both time-consuming. These problems are also encountered, for instance, when needing to remove a resonator for some reason or another. In this latter case, there is also a serious risk of the resonator, the casing or the mounting device being damaged.

SUMMARY OF THE INVENTION

The present invention tackles the problem of how dielectric resonators can be mounted in a microwave filter in a simple and inexpensive manner without impairing the electric properties of the resonators.

One method of securing dielectric resonators firmly in a microwave filter involves the step of arranging the resonators in a mounting device. The mounting device is then placed in a microwave filter cavity defined by a shielding casing. The microwave filter cavity is then assembled. The shielding casing is provided with the electrical contacts and adjustment means required to obtain a functioning resonance filter.

The dielectric resonators are fixedly mounted in the microwave filter cavity with the aid of a mounting device made of a low-loss, low-dielectric and non-conductive material, for instance a polymeric foam material that will not impair the electric properties of the filter resonators. The mounting device essentially fills all of the empty space in the filter cavity.

The mounting device is preferably made in two identical halves so as to achieve simple fixation and inexpensive manufacture. The two halves include holes whose diameters are smaller than the resonators, and recesses at said holes adapted to the resonators, so that the combined recess depths of the two halves will be equal to the thickness of the resonator. The recess diameter is the same as the resonator diameter. The mounting device is made of a polymeric foam material, preferably plastic foam, and is designed to balance-out displacements caused by thermal expansion of the resonators.

The object of the present invention is to simplify mounting of dielectric resonators in a resonance filter without impairing the electric properties of the resonators.

One advantage afforded by the present invention is that it essentially eliminates such thermal effects as stresses and displacements in the microwave filter cavity.

Another advantage afforded by the invention is that the microwave filter structure can be assembled very easily. No gluing is required, and the structure can be dismantled without the risk of damaging the structure.

Another advantage afforded by the present invention is that the resonators have good heat conductivity despite being mounted in a highly insulating material. The holes in the mounting device at the resonators permit heat to be carried away from the microwave filter cavity by convection and radiation.

Another advantage afforded by the present invention is that polymeric foam material, and particularly plastic foam, can be readily worked to a very high degree of precision. Plastic foam is also a very light material, which can also be seen as an advantage.

Finally, since the mounting device fills essentially the whole of the empty space, one and the same dielectric constant is obtained within the microwave filter cavity.

This together with the high symmetry of the mounting device results in a particularly good filter characteristic.

The invention will now be described in more detail with reference to preferred embodiments thereof and also with reference to the accompanying drawings.

DESCRIPTION OF PREFERRED EMBODIMENTS

Figure 1:
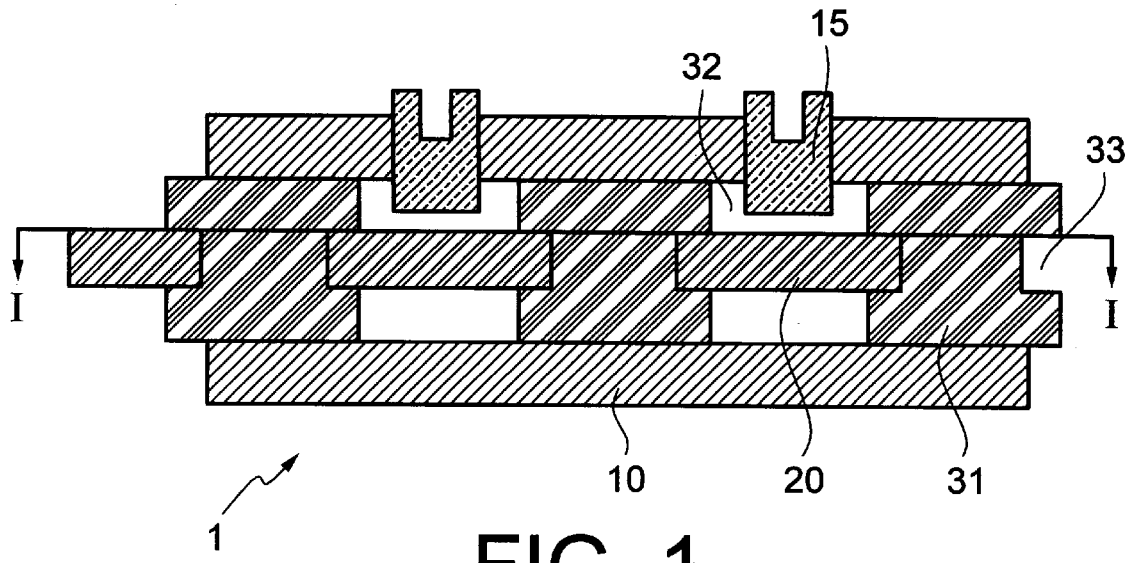
FIG. 1 is a cross-sectional view of an inventive mounting device arranged in the microwave filter cavity, along the line B—B in FIG. 2.

FIG. 1 is a partial cross-sectional view of an inventive mounting device 31 for microwave resonators 20 disposed in a dielectric resonance filter 1. The shielding casing 10 defines a microwave filter cavity in which the mounting device is placed. In the illustrated embodiment, the microwave resonators 20 are disposed so that an imaginary normal to the centre line of the microwave resonators will coincide with the centre line of the filter cavity. The resonators 20 of the illustrated embodiment have the form of straight-wall circular cylinders, although they may have any desired shape.

Figure 2:
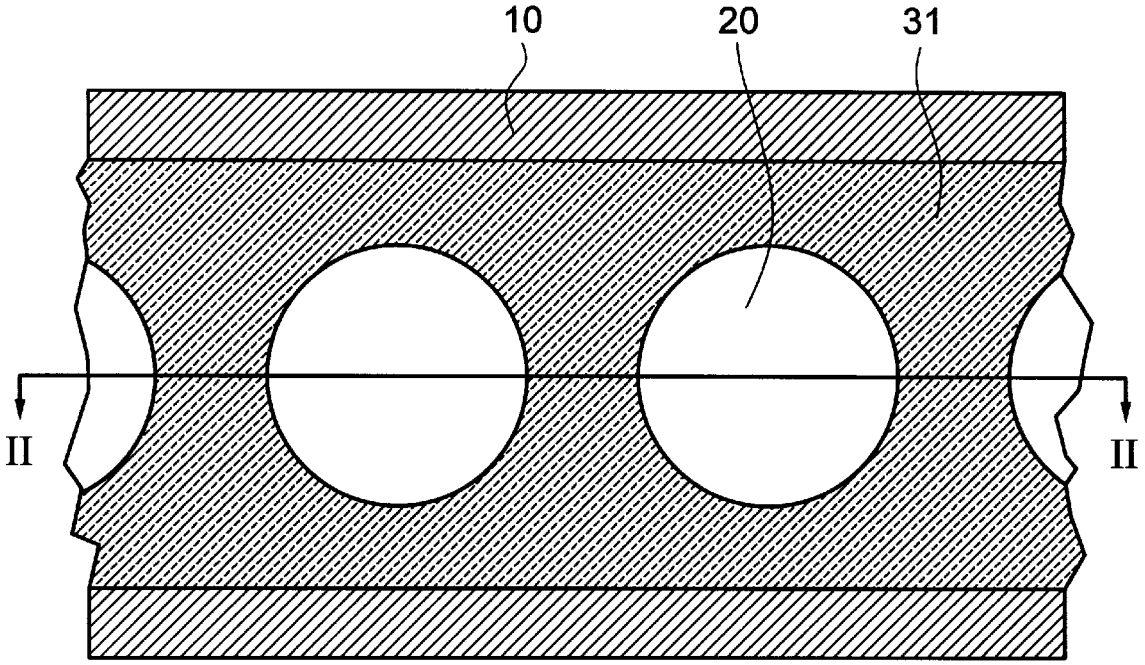
FIG. 2 is a cross-sectional view of the same mounting device and microwave filter cavity as that shown in FIG. 1, along the line A—A in FIG. 1.

The resonators 20 are held in place with the aid of a mounting device 31. The shape and size of the mounting device 31 is adapted to the shape and size of the filter cavity so that the mounting device 31 will occupy most of the cavity. The hollows 32 provided in the mounting device are contiguous with the microwave generators. Thus, hollows 32 are disposed in the mounting device 31 above and beneath the resonators. These hollow 32 have a diameter which is smaller than the diameter of the microwave resonators 20. Thus, in the case of this embodiment, the diameter of the straight-wall circular-cylindrical microwave resonators 20 is greater than the diameter of the circular-cylindrical hollows 32. Each of these hollows includes a recess or aperture 33 for affixing the microwave resonators 20 in the mounting device 31. The centres of respective recesses are in line with the centre line of the microwave filter cavity. The width of the recess is adapted to the height or thickness of the resonators. The mounting device may be made in one or more parts. When the mounting device is a singlepiece structure, the device will preferably be made from a relatively elastic material so as to enable the resonators 20 to be pressed down through respective hollows 32 and affixed in associated recesses 33. The microwave resonators 20 may alternatively be moulded firmly in the mounting device 31. In this case, the mounting device 31 and microwave resonators 20 may also have a configuration coinciding with the configuration shown in FIGS. 1 and 2. However, the mounting device 31 is preferably comprised of several parts. If the mounting device is comprised of two parts, these two parts may be made identical to one another. The plane that divides the mounting device into two parts will then pass straight through the microwave resonator receiving recesses 33 in the longitudinal direction of the mounting device 31. Irrespective of whether the mounting device is made in one piece, in several pieces or is moulded together with the microwave resonators, the mounting device 31 and the microwave resonators 20 can be assembled outside the microwave filter cavity.

In assembling the dielectric microwave filter, the microwave resonators 20 are mounted in the mounting device. The mounting device is arranged in the microwave filter cavity. The microwave filter cavity is assembled. As before mentioned, the mounting device shall fit well in the microwave filter cavity. However, the microwave filter cavity may have any selected configuration, although it will preferably have a straight rectangular-cylindrical or straight circular-cylindrical configuration.

The casing that defines the microwave filter cavity is made from a suitable material that has good electric conductivity, for instance aluminium or brass. The mounting device is made of a somewhat foamed polymer material, preferably plastic foam.

The hollows 32 at the microwave resonators enable thermal radiation to be dissipated more effectively.

Figure 3:
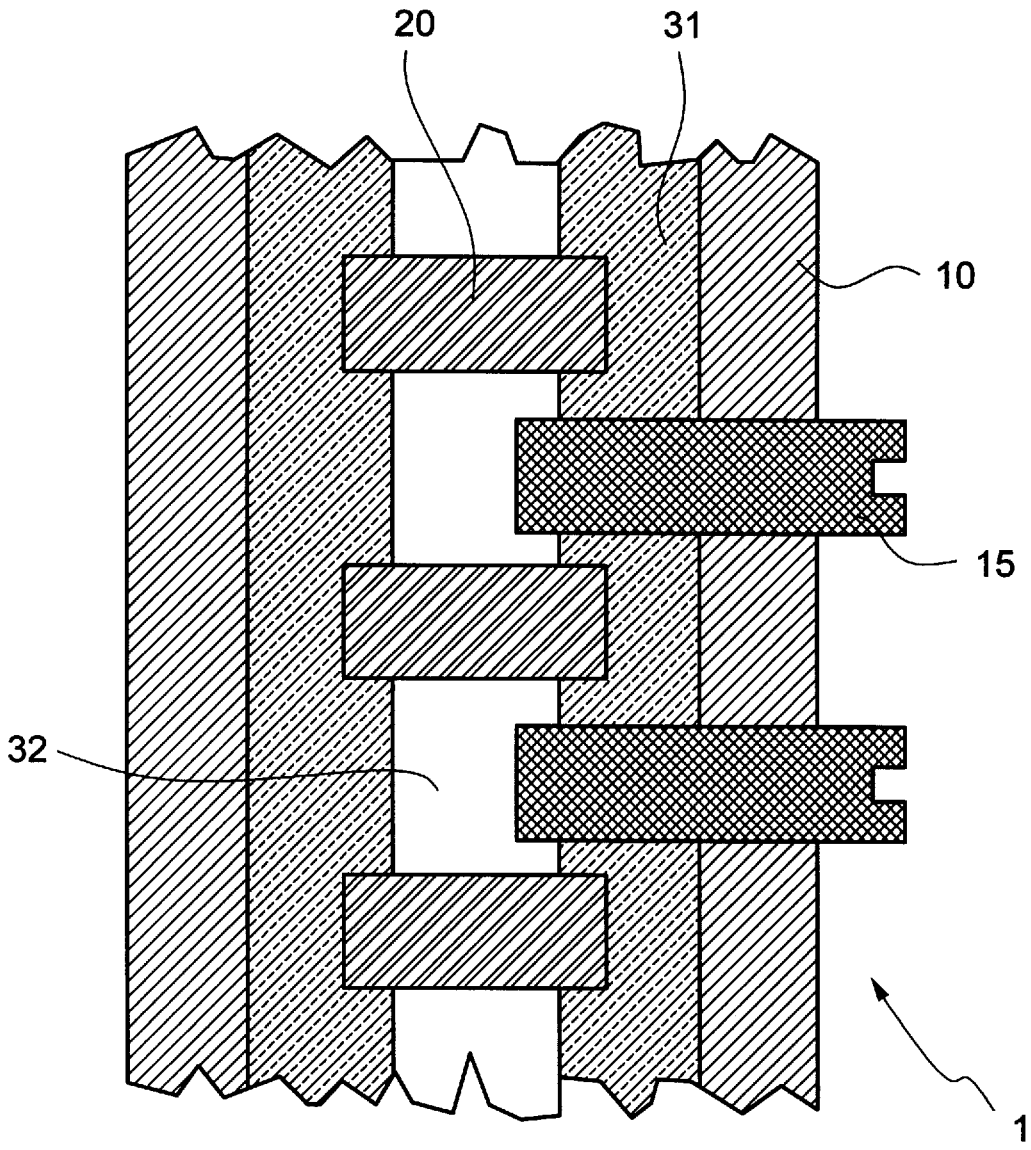
FIG. 3 is a cross-sectional view of an alternative embodiment of the inventive mounting device arranged in another type of microwave filter cavity.

FIG. 3 is a part cross-sectional view of another embodiment of a dielectric microwave filter. In this embodiment, the microwave resonators lie in the filter cavity such that the centre line of respective resonators coincides with the centre line of the filter cavity. In other words, it can be said that the straight-wall circular-cylindrical microwave resonators lie stacked one upon the other. As with the earlier described embodiment, the mounting device 31 of the FIG. 3 embodiment may either comprise a single part or several parts, or may be moulded together with the microwave resonators. As with the former embodiment, the mounting device will be made of a material which is sufficiently elastic to enable the microwave resonators 20 to be pressed down in the mounting device when said device is a single-piece structure. When the mounting device is made in two parts for instance, the cutting plane that separates the two parts may be chosen so that the parts will be mutually identical, which results in cheaper and more effective manufacture. The recesses 33 in the mounting device 31 are well-adapted to the microwave resonators 20.

Because the mounting device 31 and the microwave resonators 20 can be assembled outside the microwave filter cavity, the cavity opening through which the mounting device 31 is inserted may be placed in any desired position. The only criterion in this regard is that the opening to the microwave filter cavity will be sufficiently large to enable the mounting device 31 to be inserted.

The electrical contacts and adjustment devices (15) required for the dielectric microwave filter to function and to be finely adjusted are provided on the sides of the filter cavity. Such features are generally known in the art and do not belong to the present invention, and they will not therefore be described in more detail in this document.

It should be understood that the invention is not restricted to the aforedescribed and illustrated embodiments thereof, and that modifications can be made within the scope of the following Claims.

We claim:

1. A mounting device for mounting at least one dielectric microwave resonator in a dielectric resonance filter comprising: a polymer foam body having an outer surface formed such that the body fits into, and occupies substantially all of a cross-sectional portion of, a microwave filter cavity defined by a shielding casing and having at least one hollow within whose defining surface there is provided at least one recess for affixing the at least one microwave resonator in the mounting device, wherein the at least one resonator is arranged in the mounting device such that a normal to a center line of the at least one microwave resonator coincides with a center line of the microwave filter cavity.

2. A mounting device according to claim 1, wherein the hollow has a straight-wall circular-cylindrical configuration the diameter of the hollow is smaller than the diameter of the straight-wall circular-cylindrical configuration, and the recess is adapted to the shape and size of the at least one dielectric microwave resonator.

3. A mounting device according to claim 1, wherein the at least one microwave resonator is molded in the mounting device.

4. A mounting device according to claim 1, wherein the mounting device is a single-part structure.

5. A mounting device according to claim 1, wherein the mounting device is comprised of at least two parts.

* * * * *